US006361630B2

(12) United States Patent
Helmy et al.

(10) Patent No.: US 6,361,630 B2
(45) **Date of Patent: *Mar. 26, 2002**

(54) COOL BURNING GAS GENERATING COMPOSITION

(75) Inventors: Abdel K. Helmy; Tracy N. Michon, both of Sparks, NV (US)

(73) Assignee: TRW Inc., Lyndhurst, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/376,738

(22) Filed: Aug. 17, 1999

(51) Int. Cl.[7] ..... C06B 45/10; C06B 31/00; C06B 31/28; C06B 25/34

(52) U.S. Cl. ..... 149/19.4; 149/19.5; 149/45; 149/46; 149/62; 149/78; 149/92

(58) Field of Search ..... 149/36, 19.4, 19.5, 149/46, 45, 62, 78, 92

(56) References Cited

U.S. PATENT DOCUMENTS

| | | | | | |
|---|---|---|---|---|---|
| 3,625,782 | A | * | 12/1971 | Oberth | 149/19 |
| 3,910,805 | A | | 10/1975 | Catanzarite | 149/83 |
| 3,954,528 | A | * | 5/1976 | Cahng et al. | 149/19.4 |
| 3,964,255 | A | | 6/1976 | Catanzarite | 60/205 |
| 4,179,327 | A | | 12/1979 | Seldner | 156/667 |
| 5,035,757 | A | * | 7/1991 | Poole | 149/46 |
| 5,386,775 | A | * | 2/1995 | Poole et al. | 149/36 |
| 5,462,306 | A | | 10/1995 | Barcaskey | 280/736 |
| 5,531,941 | A | | 7/1996 | Poole | 264/3.4 |
| 5,536,339 | A | | 7/1996 | Verneker | 149/19.5 |
| 5,544,687 | A | * | 8/1996 | Barnes et al. | 149/83 |
| 5,551,725 | A | * | 9/1996 | Ludwig | 280/737 |
| 5,773,754 | A | | 6/1998 | Yamato | 149/36 |
| 5,780,768 | A | * | 7/1998 | Knowlton et al. | 149/36 |
| 5,783,773 | A | | 7/1998 | Poole | 149/36 |
| 5,989,367 | A | * | 11/1999 | Zeuner et al. | 149/47 |
| 6,019,861 | A | * | 2/2000 | Canterberry et al. | 149/19.1 |
| 6,077,371 | A | * | 6/2000 | Lundstrom et al. | 149/37 |

* cited by examiner

*Primary Examiner*—Michael J. Carone
*Assistant Examiner*—Aileen J. Baker
(74) *Attorney, Agent, or Firm*—Tarolli, Sundheim, Covell, Tummino & Szabo L.L.P.

(57) ABSTRACT

An apparatus (10) comprises an inflatable vehicle occupant protection device (16) and a gas generating composition which when ignited produces gas to inflate the inflatable vehicle occupant protection device (16). The gas generating composition comprises a non-azide nitrogen containing organic fuel, an inorganic salt oxidizer, and a metal organic coolant selected from the group consisting of alkali metal formates, alkaline earth metal formates, alkali metal oxalates, and alkaline earth metal oxalates. The amount of metal organic coolant in the gas generating composition is a cooling amount.

17 Claims, 1 Drawing Sheet

COOL BURNING GAS GENERATING COMPOSITION

FIELD OF THE INVENTION

The present invention relates to a non-azide based gas generating composition. The gas generating composition of the present invention is particularly useful for inflating an inflatable vehicle occupant protection device.

BACKGROUND OF THE INVENTION

An inflator for inflating an inflatable vehicle occupant protection device, such as an air bag, contains a body of ignitable gas generating material. The inflator further includes an igniter. The igniter is actuated so as to ignite the body of gas generating material when the vehicle experiences a collision for which inflation of the air bag is desired to help protect a vehicle occupant. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

Azide based gas generating compositions for generating gas to inflate an inflatable vehicle occupant protection device have the advantage that they produce non-toxic nitrogen gas during combustion and produce gas at relatively low gas temperatures. Non-azide based gas generating compositions, in contrast, typically produce gas at temperatures well above the temperature of gas produced by azide based gas generating compositions with some approaching 4000 K.

While non-azide based gas generating compositions potentially are thermodynamically efficient, they present heat management problems. For instance, it may be necessary, because of the high temperatures, to manufacture certain components of the vehicle occupant protection device of more expensive materials that are resistant to the high temperature gas which is generated. In addition, the non-azide based gas generating compositions tend to produce reaction products which may be in the vapor phase at high temperatures and thus more difficult to filter.

Various attempts to cool non-azide based gas generating compositions include adding chemical coolants to the compositions. Chemical coolants, however, tend to add to the volume of the gas generating material required without increasing the gas output. This reduces the gas output per volume of gas generating material in an amount dependent upon the amount of the coolant added.

SUMMARY OF THE INVENTION

The present invention is an apparatus comprising an inflatable vehicle occupant protection device and a gas generating composition that, when ignited, produces gas to inflate the inflatable vehicle occupant protection device. The gas generating composition comprises a non-azide nitrogen containing organic fuel, an inorganic salt oxidizer, and a metal organic coolant. The metal organic coolant is selected from the group consisting of alkali metal formates, alkaline earth metal formates, alkali metal oxalates, and alkaline earth metal oxalates. The amount of metal organic coolant in the gas generating composition is a cooling amount. A preferred non-azide nitrogen containing organic fuel is one selected from the group consisting of guanidine nitrate, triaminoguanidine nitrate, and mixtures of guanidine nitrate and triaminoguanidine nitrate.

BRIEF DESCRIPTION OF THE DRAWINGS

The foregoing and other features of the present invention will become more apparent to one skilled in the art upon consideration of the following description of the invention and the accompanying drawing in which.

DESCRIPTION OF PREFERRED EMBODIMENTS

Figure 1:
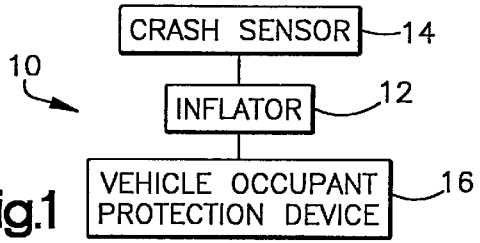
FIG. 1 is a schematic view of a vehicle occupant protection apparatus embodying the present invention.

Referring to FIG. 1, a vehicle occupant protection apparatus 10 includes an inflatable vehicle occupant protection device 16. In the preferred embodiment of the present invention, the inflatable vehicle occupant protection device 16 is an air bag. The inflatable vehicle occupant protection device 16 could alternatively be, for example, an inflatable seat belt, an inflatable knee bolster, an inflatable head liner, an inflatable side curtain, or a knee bolster operated by an air bag.

An inflator 12 is associated with the vehicle occupant protection device 16. The inflator 12 is actuatable to generate inflation fluid to inflate the inflatable vehicle occupant protection device 16.

The apparatus 10 also includes a crash sensor 14. The crash sensor 14 is a known device that senses a vehicle condition, such as vehicle deceleration, indicative of a collision or rollover. The crash sensor 14 measures the magnitude and duration of the deceleration. If the magnitude and duration of the deceleration meet predetermined threshold levels, the crash sensor 14 either transmits a signal or causes a signal to be transmitted to actuate the inflator 12. The inflatable vehicle occupant protection device 16 is then inflated and extends into the occupant compartment of the vehicle to help protect a vehicle occupant from a forceful impact with parts of the vehicle.

Figure 2:
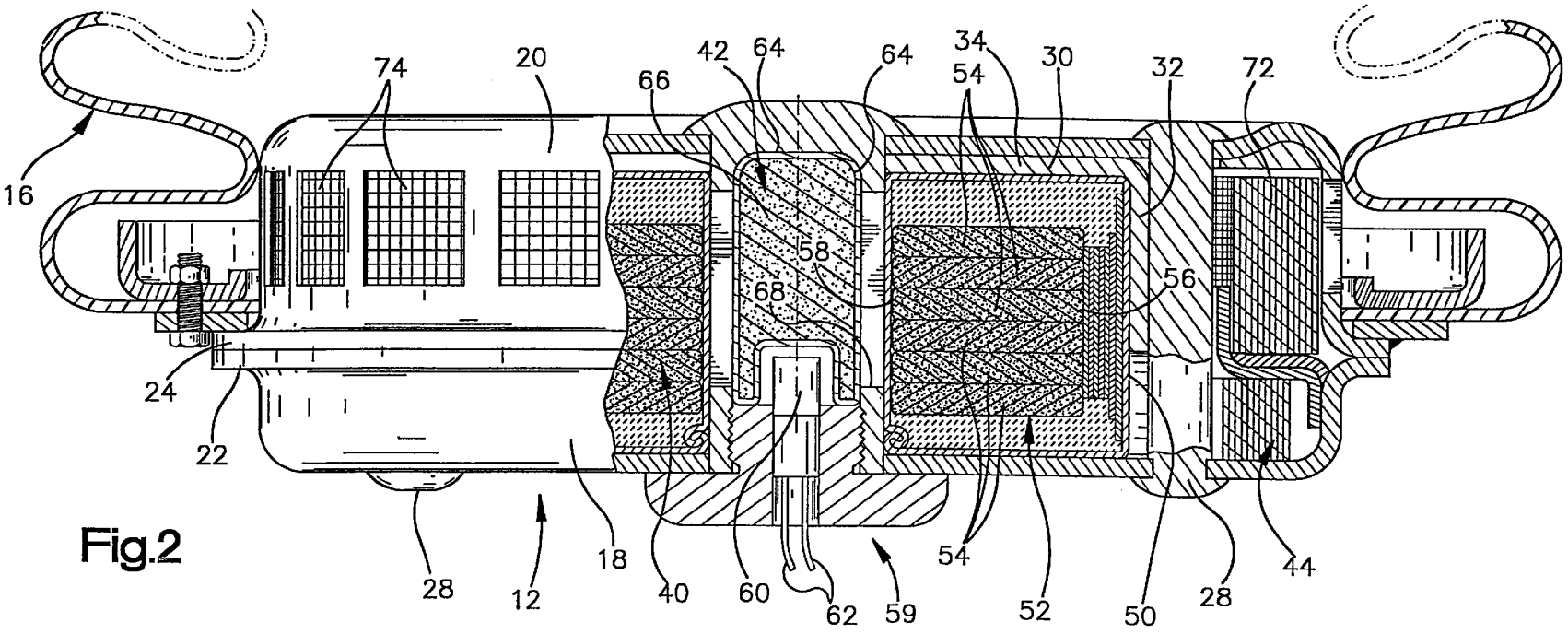
FIG. 2 is an enlarged, sectional view of a part of the apparatus of FIG. 1.

While the inflator 12 could be a hybrid inflator (not shown), in the preferred embodiment of the present invention, the inflator 12 is a pyrotechnic inflator. The specific structure of the inflator could vary. Referring to FIG. 2, the inflator 12 comprises a base section 18 and a diffuser section 20. The two sections 18 and 20 are joined together at mounting flanges, 22 and 24, which are attached to each other by a continuous weld. A plurality of rivets 28 also hold the diffuser section 20 and the base section 18 together.

A combustion cup 30 is seated between the diffuser section 20 and the base section 18. The combustion cup 30 comprises an outer cylindrical wall 32 and an annular top wall 34. The combustion cup 30 divides the inflator 12 into a combustion chamber 40, which is located within the combustion cup 30, and a filtration chamber 44, which is annular in shape and is located outside the combustion cup 30.

The combustion chamber 40 houses an inner container 50 which is hermetically sealed. The inner container 50 holds gas generating material 52, which is in the form of a plurality of gas generating disks 54. The gas generating disks 54 have a generally toroidal configuration with a cylindrical exterior surface 56 and an axially extending hole defined by a cylindrical interior surface 58. The disks 54 are positioned in the container in a stacked relationship with the axially extending holes in alignment. The cylindrical interior surfaces 58 encircle an ignition chamber 42. Each disk 54 has generally flat opposed surfaces and may have protuberances on such surfaces to space one disk slightly from another. This configuration of the disks 54 promotes a uniform combustion of the disks 54. Other configurations of the gas generating material 52 can also be used.

The ignition chamber 42 is defined by a two-piece, tubular igniter housing 59 that fits within the combustion cup 30 and the disks 54 and contains a squib 60. The squib 60 contains a small charge of ignitable material (not shown). Electric leads 62 convey a current to the squib 60. The current is provided when the crash sensor 14, which is responsive to a condition indicative of a vehicle collision, closes an electrical circuit that includes a power source (not shown). The current generates heat in the squib 60 which ignites the ignitable material. The ignition chamber 42 also has a canister 64 which contains a rapidly combustible pyrotechnic material 66 such as boron potassium nitrate. The rapidly combustible pyrotechnic material 66 is ignited by the small charge of ignitable material of the squib 60. The burning pyrotechnic material 66 exits from the ignition chamber 42 through openings 68 in the igniter housing which lead to the combustion chamber 40. The burning pyrotechnic material 66 penetrates the container 50 and ignites the gas generating disks 54. Other ignition systems capable of igniting the disks 54 are well known and can be used with the present invention.

The inflator 12 also comprises a filter assembly 72 in the filtration chamber 44. The filter assembly 72 is in the flow path between the combustion chamber 40 and the vehicle occupant protection device 16. The filter assembly 72 functions to remove solid products of combustion from the combustion gasses and prevent their entry into the vehicle occupant protection device 16. The filter assembly 72 also cools the products of combustion of the disks 54.

The gas generating composition of which the disks 54 are made comprises a non-azide nitrogen containing organic fuel, an inorganic salt oxidizer, and a metal organic coolant. A preferred non-azide nitrogen containing organic fuel is selected from the group consisting of guanidine nitrate, triaminoguanidine nitrate, and mixtures of guanidine nitrate and triaminoguanidine nitrate. Guanidine nitrate, triaminoguanidine nitrate, and mixtures of guanidine nitrate and triaminoguanidine nitrate are preferred non-azide nitrogen containing organic fuels because these fuels are mechanically stable, have upon combustion a high impetus as compared to other non-azide nitrogen containing organic fuels, and are relatively inexpensive.

The non-azide nitrogen containing organic fuel can also be other nitrogen containing organic fuels typically used in a gas generating composition including: cyanamides such as dicyanamide and salts of cyanamides; tetrazoles such as 5-aminotetrazole and derivatives and salts of tetrazoles; carbonamides such as azo-bis-dicarbonamide and salts of carbonamide; triazoles such as 3-nitro-1,2,4-triazole-5-one (NTO) and salts of triazoles; guanidine and other derivatives of guanidine such as nitroguanidine and other salts of guanidine and guanidine derivatives; tetramethyl ammonium nitrate; urea and salts of urea; nitramines such as cyclotrimethylenetrinitramine and cyclotetramethylenetetranitramine; and mixtures thereof.

The amount of non-azide nitrogen containing organic fuel in the gas generating composition is that amount necessary to achieve sustained combustion of the gas generating composition. This amount can vary depending upon the particular non-azide nitrogen containing organic fuel involved and the other reactants that are added to the gas generating composition. Preferably, the amount of non-azide nitrogen containing organic fuel is from about 15% to about 35% by weight based on the weight of the gas generating composition.

The inorganic salt oxidizer in the gas generating composition of the present invention can be any inorganic oxidizer salt commonly used in a vehicle occupant protection device. Preferred inorganic salt oxidizers include alkali metal nitrates, alkaline earth metal nitrates, alkali metal perchlorates, alkaline earth metal perchlorates, ammonium perchlorate and ammonium nitrate. A preferred inorganic salt oxidizer is strontium nitrate $Sr(NO_3)_2$.

When ammonium nitrate is used as the inorganic salt oxidizer, the ammonium nitrate is preferably phase stabilized. The phase stabilization of ammonium nitrate is well known. In one method, the ammonium nitrate is doped with a metal cation in an amount which is effective to minimize the volumetric and structural changes associated with phase transitions inherent to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can be also be stabilized by doping with copper and zinc ions. Other compounds, modifiers, and methods that are effective to phase stabilize ammonium nitrate are well known and suitable in the present invention.

The amount of inorganic salt oxidizer in the gas generating composition is that amount necessary to achieve sustained combustion of the gas generating composition. A preferred amount of inorganic salt oxidizer is in the range of about 30% to about 50% by weight based on the weight of the gas generating composition.

The gas generating composition of the present invention further comprises a metal organic coolant. The metal organic coolant is selected from the group consisting of alkali metal formates, alkaline earth metal formates, alkali metal oxalates, alkaline earth metal oxalates, and mixtures thereof. A preferred metal organic coolant is calcium formate.

The amount of metal organic coolant in the gas generating composition is that amount to reduce (i.e. cool) the combustion temperature of the gas generating composition. Preferably, the amount of metal organic coolant is that amount effective to cause liquid particles formed upon combustion of the gas generating composition to coalesce into an easily filterable slag. More preferably, the amount of metal organic coolant is from about 15% to about 25% by weight based on the weight of the gas generating composition.

In the present invention, the metal organic coolant functions by lowering the overall net heat of reaction of the gas generating composition, thereby reducing the combustion temperature of the gas generating composition. The formate or oxalate reacts with the inorganic oxidizer in a combustion reaction that is similar to the combustion of the nitrogen containing organic fuel. The net heat of reaction from the combustion of the metal organic coolant with the inorganic salt oxidizer is substantially lower than the net heat of reaction from the combustion of the non-azide nitrogen containing organic fuel with inorganic salt oxidizer. Thus, when the metal organic coolant is combined with the inorganic salt oxidizer and the non-azide nitrogen containing organic fuel, the overall net heat of reaction of the gas generating composition is lowered by an amount that is proportional to the amount of formate or oxalate in the gas generating composition.

At the same time, since the formate or oxalate consists to a large extent of carbon, hydrogen, and oxygen atoms, the formate or oxalate reacts with the inorganic salt oxidizer to produce upon combustion a gaseous reaction product that contributes to a large extent to the inflation of the vehicle occupant protection device. This is illustrated by way of example in the following equation:

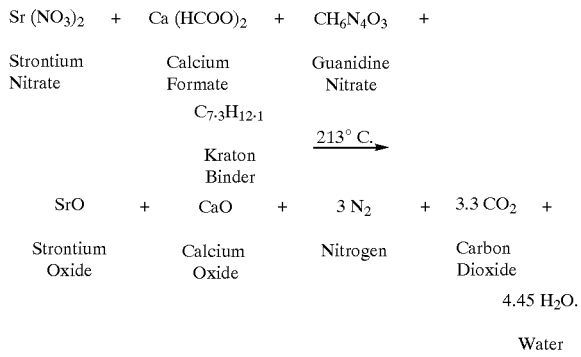

Thus, with regard to the production of a given volume of an inflation gas, the composition of the present invention, comprising a nitrogen containing organic fuel in combination with a formate or oxalate, burns at a lower combustion temperature than one in which there is no formate or oxalate.

The metal oxides in the above equation which are produced upon combustion combine to form a eutectic which has a low melting point. The low melting point of the eutectic assures that the eutectic will upon combustion be in a liquid state. The eutectic in a liquid state can coalesce and solidify on the cooler surfaces of the filter 72 in the form of an easily filtered ceramic slag.

The metal oxides produced upon combustion of the gas generating composition retain a substantial proportion of the reaction heat. Since the metal oxides collect in the filter 72, much of the heat remains in the inflator 12 and is not conveyed to the vehicle occupant protection device 16. The enhanced retention of heat in the inflator 12 permits the use of non-azide nitrogen containing organic fuels having higher net heats of reaction than could be tolerated if the non-gaseous materials produced upon combustion of the gas generating composition passed to the vehicle occupant protection device 16.

The non-azide nitrogen containing organic fuel, the inorganic salt oxidizer, and metal organic coolant are incorporated into the gas generating composition in the form of finely divided powders. The average particle size of the fuel is from about 0.5 $\mu$m to about 10 $\mu$m. Preferably, the average particle size of the fuel is about 1 $\mu$m. The average particle size of the oxidizer is from about 10 $\mu$m to about 30 $\mu$m. Preferably, the average particle size of the oxidizer is about 20 $\mu$m. The average particle size of the coolant is about 10 $\mu$m to about 30 $\mu$m. Preferably, the average particle size of the coolant is about 20 $\mu$m.

When the average particle sizes of the non-azide nitrogen containing organic fuel, inorganic salt oxidizer, and/or metal organic coolant are above the aforesaid limits, the burn rate of the gas generating composition may be slower than desired for deployment of the vehicle occupant protection device 16. When the average particle sizes of non-azide nitrogen containing organic fuel, inorganic salt oxidizer, and/or metal organic coolant are below the aforesaid lower limits, the burn rate of the gas generating composition may be more rapid than desired for controlled evolution of gas.

The gas generating composition of the present invention preferably includes a binder. Preferably the binder is non-energetic. Suitable binders for gas generating compositions are well known in the art. Preferred binders include cellulose based binders such as cellulose acetate butyrate (CAB), polycarbonates, polyurethanes, polyesters, polyethers, polysuccinates, thermoplastic rubbers, polybutadiene, polystyrene, and mixtures thereof. A preferred binder is KRATON (trademark), a polyethylene/butylene-polystyrene block copolymer manufactured by Shell Chemical Company.

A preferred amount of binder is from about 0 to about 10% by weight based on the weight of the gas generating composition. More preferably, the amount of binder is from about 2.5% to about 5% by weight based on the weight of the gas generating composition.

The gas generating composition may comprise a burn rate modifier. Examples of suitable burn rate modifiers include cyclotetramethylenetetranitramine (HMX), cyclotrimethylenetrinitramine (RDX), iron oxide ($Fe_2O_3$), and mixtures thereof.

A preferred amount of burn rate modifier is from about 0 to about 20% by weight based on the weight of the gas generating composition. More preferably, the amount of burn rate modifier is from about 5% to about 15% by weight of the gas generating composition.

Preferably, the components of the gas generating composition are present in a weight ratio adjusted to produce upon combustion a reaction gas product that is substantially free of carbon monoxide. In other words the carbon in the reaction mixture is substantially or completely oxidized to carbon dioxide.

EXAMPLE 1

A gas generating composition was prepared by combining, in a Baker Perkins mixing device, 16 ml of (14.67 g or 4.89%) of KRATON binder, 14.31 grams (4.77%) of powdered cyclotetramethylenetetranitramine (HMX), 90 grams (30%) of powdered guanidine nitrate (GDN), 60 grams (20%) of powdered calcium formate ($Ca(HCOO)_2$), and 120 grams (40.34%) of powdered strontium nitrate ($Sr(NO_3)_2$). The cyclotetramethylenetetranitramine (HMX) had an average particle size of about 15 $\mu$m; the guanidine nitrate (GDN) had an average particle size of about 1 $\mu$m; the calcium formate ($Ca(HCOO)_2$) had an average particle size of about 20 $\mu$m; and the strontium nitrate had an average particle size of about 17 $\mu$m.

After combining the KRATON, which was in liquid form, the cyclotetramethylenetetranitramine (HMX), the guanidine nitrate (GDN), the calcium formate ($Ca(HCOO)_2$), and the strontium nitrate ($Sr(NO_3)_2$), the mixture was tested for sensitivity to hazardous stimuli. The mixture was found to be insensitive, measuring beyond the limit of laboratory instrumentation at more than 80 cm impact and 36 kilo-pons friction. Both values meet impact and friction criteria for a gas generating composition for a vehicle occupant protection apparatus. Thermal analysis by differential scanning calorimetry revealed that the composition had a broad exotherm at 213° C., indicating that the composition decomposed into a gas at a steady rate.

The KRATON, cyclotetramethylenetetranitramine (HMX), guanidine nitrate (GDN), calcium formate ($Ca(HCOO)_2$), and strontium nitrate ($Sr(NO_3)_2$) gas generating composition was compacted under a compaction pressure of 11,000 ft-lb (1521 kg-m) into tablets having a diameter of approximately 1.3 cm, a thickness of 0.73 cm, and a density of 1.47 g/cm$^3$.

Burning rate samples of the tablets were tested in a closed bomb having a volume of 64.6 ml. At 2000 psi (13.8 Mpa), the burning rate was found to be 1.40 cm/s.

The following Table 1 gives additional computer generated thermochemical data obtained relative to the combustion of the KRATON, cyclotetramethylenetetranitramine (HMX), guanidine nitrate (GDN), calcium formate ($Ca(HCOO)_2$), and strontium nitrate ($Sr(NO_3)_2$) gas generating composition.

TABLE 1

| Formulation | |
|---|---|
| Strontium Nitrate, wt. % | 40.34 |
| Calcium Formate, wt. % | 20 |
| Guanidine Nitrate, wt. % | 30 |
| HMX, wt. % | 4.77 |
| KRATON, wt. % | 4.89 |
| Performance Criteria | |
| Flame temperature, K. | 1438 |
| Exhaust temperature, K. | 860 |
| Exhaust gas moles/100 g | 2.5 |
| Impetus J/g | 167.12 |

Referring to Table 1, Example 1 contains by weight of the gas generating composition 40.34% strontium nitrate ($Sr(NO_3)_2$), 20% calcium formate ($Ca(HCOO)_2$), 30% guanidine nitrate (GDN), 4.77% cyclotetramethylenetetranitramine (HMX), and 4.89% KRATON binder, for substantially complete combustion of the carbon atoms in the gas generating composition to carbon dioxide. The flame temperature and exhaust temperature of Example 1 meet criteria for a gas generating composition for inflating a vehicle occupant protection device. The amount of gas produced upon combustion and its energy (impetus) are effective for actuating a vehicle occupant protection device such as an air bag.

Comparative Example 1

A gas generating composition was prepared comprising KRATON, cyclotetramethylenetetranitramine (HMX), guanidine nitrate (GDN), and strontium nitrate ($Sr(NO_3)_2$). The KRATON, the cyclotetramethylenetetranitramine (HMX), the guanidine nitrate (GDN), and the strontium nitrate ($Sr(NO_3)_2$) were prepared separately as powders, mixed, and compacted into tablets as in Example 1. Computer generated thermochemical data for the combustion of the tablets are listed in the following Table 2 along with the results of Example 1 for the purposes of comparison.

TABLE 2

| | Comp. EX 1 | EX 1 |
|---|---|---|
| Strontium Nitrate, wt. % | 50.43 | 40.34 |
| Calcium Formate, wt. % | — | 20 |
| Guanidine Nitrate, wt. % | 37.50 | 30 |
| HMX, wt. % | 5.96 | 4.77 |
| KRATON, wt. % | 6.11 | 4.89 |
| Performance Criteria | | |
| Flame temperature, K. | 2083 | 1438 |
| Exhaust temperature, K. | 1001 | 860 |
| Exhaust gas moles/100 g | 3.0 | 2.5 |
| Impetus J/g | 652.9 | 167.12 |

Table 2 shows that the KRATON, cyclotetramethylenetetranitramine (HMX), guanidine nitrate (GDN), calcium formate ($Ca(HCOO)_2$), and strontium nitrate ($Sr(NO_3)_2$) gas generating composition (EX 1) has a substantially lower flame temperature (i.e. more than 600K) and exhaust temperature (i.e. about 140 K) than the KRATON, cyclotetramethylenetetranitramine (HMX), guanidine nitrate (GDN), and strontium nitrate ($Sr(NO_3)_2$) gas generating composition (Comparative EX 1). This lower flame temperature and exhaust temperature can be attributed to the addition of the calcium formate coolant in Example 1.

Furthermore, the KRATON, cyclotetramethylenetetranitramine (HMX), guanidine nitrate (GDN), calcium formate ($Ca(HCOO)_2$), and strontium nitrate ($Sr(NO_3)_2$) gas generating composition (EX 1) did not show a substantial decrease in the volume of gas produced upon combustion as compared to the gas generating composition of Comp. Example 1. Example 1 produced upon combustion 2.5 mole/100 g of gas as compared to 3.0 moles/100 g for Comparative Example 1.

EXAMPLES 2–5

Additional formulations (Examples 2–5) comprising strontium nitrate ($Sr(NO_3)_2$), calcium formate ($Ca(HCOO)_2$), guanidine nitrate (GDN), cyclotetramethylenetetranitramine (HMX), and KRATON were prepared and tested as in Example 1. Iron oxide ($Fe_2O_3$) was added as a burn rate modifier to the formulations of Examples 4–5. The formulations and test results of Examples 2–5 are given in Table 3.

TABLE 3

| | EX 2 | EX 3 | EX 4 | EX 5 |
|---|---|---|---|---|
| $Sr(NO_3)_2$ wt. % | 40.14 | 40.14 | 40.14 | 40.14 |
| $Ca(HCOO)_2$ wt. % | 20 | 20 | 19 | 19 |
| GDN wt. % | 25 | 20 | 20 | 25 |
| HMX wt. % | 10 | 15 | 15 | 10 |
| $Fe_2O_3$ wt. % | — | — | 1 | 1 |
| KRATON wt. % | 4.86 | 4.86 | 4.86 | 4.86 |
| Performance Criteria | | | | |
| Ignition T, ° C. | 213 | 213 | 213 | 213 |
| Burn Rate, cm/sec | 1.61 | 1.76 | 1.86 | 1.70 |
| Flame T, K. | 1567 | 1699 | 1715 | 1581 |
| Exhaust T, K. | 894 | 928 | 933 | 897 |
| Exhaust gas moles/100 g | 2.58 | 2.60 | 2.58 | 2.57 |
| Impetus J/g | 179.76 | 191.35 | 190.92 | 179.63 |

Referring to Table 3, Example 2 contains, by weight of the gas generating composition, 40.14% strontium nitrate ($Sr(NO_3)_2$), 20% calcium formate ($Ca(HCOO)_2$), 25% guanidine nitrate (GDN), 10% cyclotetramethylenetetranitramine (HMX), and 4.86% KRATON binder, for substantially complete combustion of the carbon atoms in the gas generating composition to carbon dioxide. The ignition temperature, burn rate, flame temperature, exhaust temperature, moles of gas produced, and impetus are all within acceptable performance specifications for gas generating compositions used in vehicle occupant protection apparatuses.

Example 3 contains, by weight of the gas generating composition, 40.14% strontium nitrate ($Sr(NO_3)_2$), 20% calcium formate ($Ca(HCOO)_2$), 20% guanidine nitrate (GDN), 15% cyclotetramethylenetetranitramine (HMX), and 4.86% KRATON binder, for substantially complete combustion of the carbon atoms in the gas generating composition to carbon dioxide. The ignition temperature, burn rate, flame temperature, exhaust temperature, moles of gas produced, and impetus are all within acceptable performance specifications for gas generating compositions used in vehicle occupant protection apparatuses.

Example 4 contains, by weight of the gas generating composition, 40.14% strontium nitrate ($Sr(NO_3)_2$), 19% calcium formate ($Ca(HCOO)_2$), 20% guanidine nitrate (GDN), 15% cyclotetramethylenetetranitramine (HMX), 1% iron oxide ($Fe_2O_3$), and 4.86% KRATON binder, for substantially complete combustion of the carbon atoms in the gas generating composition to carbon dioxide. The ignition temperature, burn rate, flame temperature, exhaust temperature, moles of gas produced, and impetus are all within acceptable performance specifications for gas generating compositions used in vehicle occupant protection apparatuses.

Example 5 contains, by weight of the gas generating composition, 40.14% strontium nitrate ($Sr(NO_3)_2$), 19% calcium formate ($Ca(HCOO)_2$), 25% guanidine nitrate (GDN), 10% cyclotetramethylenetetranitramine (HMX), 1% iron oxide ($Fe_2O_3$), and 4.86% KRATON binder, for substantially complete combustion of the carbon atoms in the gas generating composition to carbon dioxide. The ignition temperature, burn rate, flame temperature, exhaust temperature, moles of gas produced, and impetus are all within acceptable performance specifications for gas generating compositions used in vehicle occupant protection apparatuses.

Advantages of the present invention should now be apparent. Primarily the present invention takes advantage of the favorable performance characteristics of using a gas generating composition comprising a non-azide nitrogen containing organic fuel, an inorganic salt oxidizer, and a metal organic coolant selected from the group consisting of alkali metal formates, alkaline earth metal formates, alkali metal oxalates, and alkaline earth metal oxalates. The gas generating composition of the present invention does not show a substantial loss in the volume of gas produced compared to gas generating compositions which do not include a metal organic coolant. Additionally, the gas generating composition of the present invention offers improved mechanical stability without sacrificing chemical stability. Furthermore, the gas generating composition of the present invention produces an improved gas product which is essentially non-toxic and free of particulates. The improvements in quality of the gas product accrue from using a metal organic coolant which forms an easily filterable slag with the inorganic salt oxidizer. Moreover, the gas generating composition of the present invention has a lower flame temperature (i.e. below about 1700 K) and a lower exhaust temperature (i.e. below about 950 K) when compared to other non-azide gas generating compositions.

From the above description of the invention, those skilled in the art will perceive improvements, changes, and modifications. Such improvements, changes and modifications within the skill of the art are intended to be covered by the appended claims.

Having described the invention the following is claimed:

1. A gas generating composition which when ignited produces gas to inflate an inflatable vehicle occupant protection consisting essentially of:

a non-azide nitrogen containing organic fuel selected from the group consisting of guanidine nitrate, triaminoguanidine nitrate, and mixtures of guanidine nitrate and triaminoguanidine nitrate;

an inorganic salt oxidizer;

a burn rate modifier selected from the group consisting of cyclotetramethylenetetranitramine, cyclotrimethylenetrinitramine, iron oxide and mixtures thereof;

0 to about 10% by weight of a non-energetic binder; and a metal organic coolant selected from the group consisting of alkali metal formates, alkaline earth metal formates, alkali metal oxalates, and alkaline earth metal oxalates;

wherein the gas generating composition upon combustion has a flame temperature less than about 1700K and produces at least about 2.5 moles/100 grams of gas.

2. The gas generating composition of claim 1 wherein the amount of formate or oxalate in the gas generating composition is that amount effective to cause liquid particles formed upon combustion of the gas generating composition to coalesce into an easily filterable slag.

3. The gas generating composition of claim 2 wherein the amount of formate or oxalate is from about 15% to about 25% based on the weight of the gas generating composition.

4. The gas generating composition of claim 2 wherein the inorganic salt oxidizer is selected from the group consisting of alkali metal nitrates, alkaline earth metal nitrates, alkali metal perchlorates, alkaline earth metal perchlorates, ammonium perchlorate, and ammonium nitrate.

5. The gas generating composition of claim 2 wherein the burn rate modifier comprises cyclotetramethylenetetranitramine.

6. The gas generating composition of claim 5 wherein the burn rate modifier further comprises iron oxide.

7. A gas generating composition which when ignited produces gas to inflate an inflatable vehicle occupant protection device comprising: a non-azide nitrogen containing organic fuel selected from the group consisting of guanidine nitrate, triaminoguanidine nitrate, and mixtures of guanidine nitrate and triaminoguanidine nitrate; an inorganic salt oxidizer; and a metal organic coolant selected from the group consisting of alkali metal formates and alkaline earth metal formates, wherein the amount of metal organic coolant in the gas generating composition is that amount effective to cause liquid particles formed upon combustion of the gas generating composition to coalesce into an easily filterable slag.

8. The gas generating composition as defined in claim 7 wherein the amount of metal organic coolant in the gas generating composition is from about 15% to about 25% based on the weight of the gas generating composition.

9. The gas generating composition as defined in claim 8 further comprising a burn rate modifier selected from the group consisting of cyclotrimethylenetrinitramine, cyclotetramethylenetetranitramine, iron oxide, and mixtures thereof.

10. The gas generating composition of claim 9 wherein the burn rate modifier comprises cyclotetramethylenetetranitramine and iron oxide.

11. The gas generating composition as defined in claim 7 wherein the gas generating composition further comprises a non-energetic binder.

12. The gas generating composition as defined in claim 7 wherein the inorganic salt oxidizer is selected from group consisting of alkali metal nitrates, alkaline earth metal nitrates, alkali metal perchlorates, alkaline earth metal perchlorates, ammonium perchlorate, and ammonium nitrate.

13. A gas generating composition which when ignited produces gas to inflate an inflatable vehicle occupant protection device comprising:

about 15% to about 35%, based on the weight of the gas generating composition, of a non-azide nitrogen containing organic fuel selected from the group consisting of guanidine nitrate, triaminoguanidine nitrate, and mixtures of guanidine nitrate and triaminoguanidine nitrate;

about 30% to about 50%, based on the weight of the gas generating composition, an inorganic salt oxidizer selected from group consisting of alkali metal nitrates, alkaline earth metal nitrates, alkali metal perchlorates, alkaline earth metal perchlorates, ammonium perchlorate, and ammonium nitrate; and about 15% to about 25%, based on the weight of the gas generating composition, of a metal organic coolant selected from the group consisting of alkali metal formates, and alkaline earth metal formates;

wherein the gas generating composition upon combustion has a flame temperature less than about 1700K and produces at least about 2.5 mole/100 g of combustion gas.

14. The gas generating composition of claim 13 further comprising a burn rate modifier selected from the group consisting of cyclotetramethylenetetranitramine, cyclotrimethylenetrinitramine, iron oxide, and mixtures thereof.

15. The gas generating composition of claim 14 wherein the burn rate modifier comprises cyctetramethylenetetranitramine.

16. The gas generating composition as defined in claim 15 wherein the oxidizer is strontium nitrate and the non-azide organic fuel is guanidine nitrate.

17. The gas generating composition as defined in claim 16 wherein the metal organic coolant is calcium formate.

* * * * *